United States Patent [19]

Edström

[11] 4,397,458

[45] Aug. 9, 1983

[54] SUCTION-TYPE INSERTER FOR PICKING UP AND TRANSPORTING NON-RIGID SHEETS

[75] Inventor: Lars G. Edström, Stockholm, Sweden

[73] Assignee: Malmöhus Invest AB, Malmö, Sweden

[21] Appl. No.: 202,639

[22] Filed: Oct. 31, 1980

Related U.S. Application Data

[62] Division of Ser. No. 9,953, Feb. 6, 1979, Pat. No. 4,349,189.

[30] Foreign Application Priority Data

| | | | |
|---|---|---|---|
| Feb. 7, 1978 | [SE] | Sweden | 7801396 |
| Feb. 7, 1978 | [SE] | Sweden | 7801397 |
| Feb. 7, 1978 | [SE] | Sweden | 7801398 |
| Feb. 7, 1978 | [SE] | Sweden | 7801399 |
| Jun. 15, 1978 | [SE] | Sweden | 7806910 |

[51] Int. Cl.[3] ..... B65H 3/08; B65H 5/08

[52] U.S. Cl. ..... 271/14; 271/93

[58] Field of Search ..... 271/93, 92, 91, 14, 271/9, 11, 12, 13, 15, 5, 107, 108, 106, 96, 94; 270/58; 414/121

[56] References Cited

U.S. PATENT DOCUMENTS

| | | | |
|---|---|---|---|
| 1,575,892 | 3/1926 | Ashby | 271/98 |
| 3,070,367 | 12/1962 | Schwebel | 271/93 |
| 3,419,263 | 12/1968 | Weidman | 271/108 |
| 3,997,153 | 12/1976 | Britt et al. | 271/93 |

*Primary Examiner*—Bruce H. Stoner, Jr.

*Attorney, Agent, or Firm*—Frishauf, Holtz, Goodman & Woodward

[57] ABSTRACT

An inserter for picking, transportation and depositing of non-rigid sheet-like or folded material one at a time from a material bundle to a depositing station, comprises at least one reciprocatingly movable suction head mounted relative to the material bundle so as to be operable at a given level, the suction head being reciprocatingly movable in only one plane from a first position in said one plane above the material bundle but proximal to that end part of the material bundle located nearest to a depositing station to a second position in said one plane at the depositing station and back again to said first position for transport of said material. At least one prelifter having a suction head is mounted adjacent the material bundle to pick up at least the end portion of one material at a time from the material bundle to move at least said end portion of the picked-up material to said given level at which the at least one reciprocatingly movable suction head operates, the suction head of the at least one prelifter meeting the at least one reciprocatingly movable suction head at said given level and at said first position at the same time.

1 Claim, 13 Drawing Figures

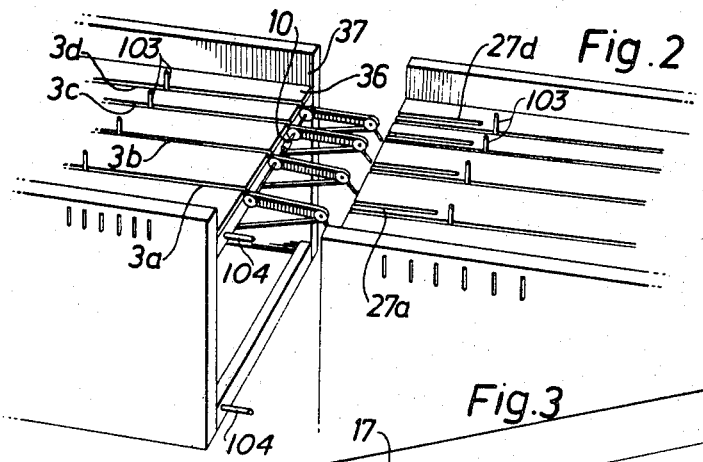
Fig. 2
Fig. 3
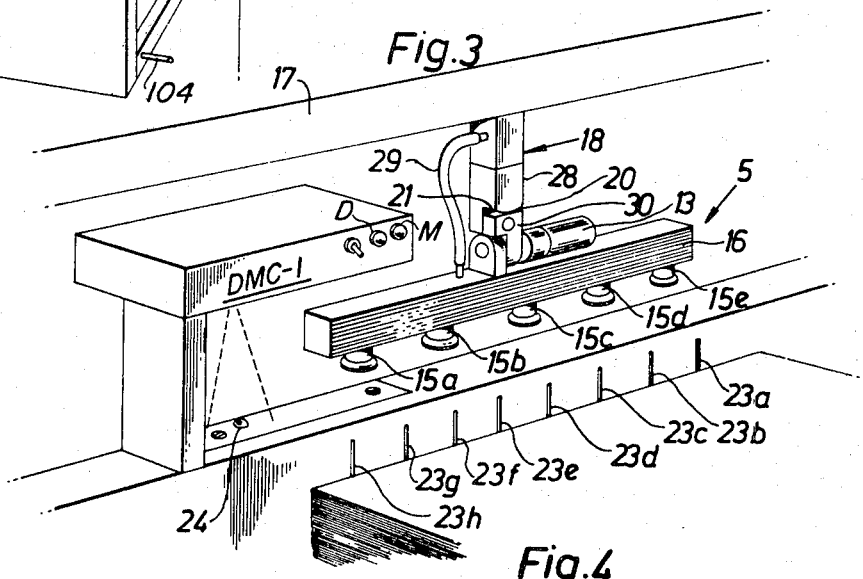
Fig. 4
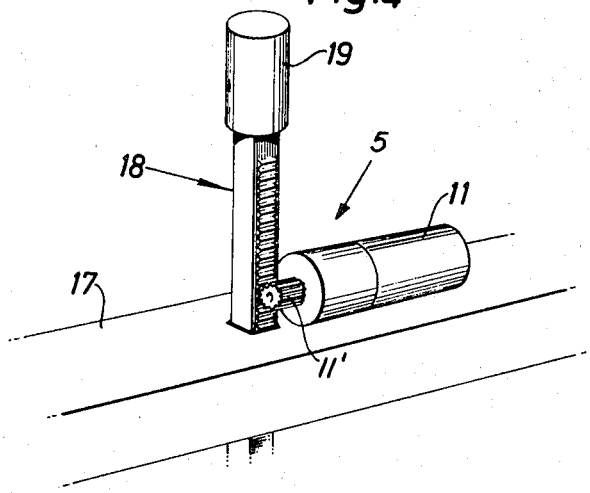

SUCTION-TYPE INSERTER FOR PICKING UP AND TRANSPORTING NON-RIGID SHEETS

This is a division of application Ser. No. 9,953 filed Feb. 6, 1979, now U.S. Pat. No. 4,349,189.

BACKGROUND OF THE INVENTION

This invention relates to a module for picking, transportation and depositing of sheeted and/or folded material from different bundles or bunches of such material on top of one another to form sets or bundles of such material.

Prior art devices of this or related kind of devices are, for example, shown in or disclosed by U.S. Pat. Nos. 928,365; 999,515; 2,406,766; 3,218,061; 329,253; and 3,391,924; in GB Pat. Nos. 1,429,887 and 1,488,879; and in German Pat. Nos. 182,765 and 943,774.

SUMMARY OF THE INVENTION

One feature of this invention is the provision of a conveyor module for transport and registration of sheeted or folded material.

A second feature of the invention is the provision a module for picking and depositing sheeted or folded material on top of one other to form a set or a bundle such that a combined machine of independently acting modules is obtained, which modules can be provided in optional numbers. Said modules easily can be put together to adapt the combined machine to the number of sheets desired in each set of material.

Another feature of the invention is the provision of an inserter, which can pick different sheets of material by means of suction, for example, from a raised or erected and/or lying position, and to transport to and deposit such sheets in the position desired, preferably in the conveyor part of a module.

A fourth feature of the invention is a method for calibration and adjustment of an inserter working with air suction for picking a sheeted or folded material one at a time from a bunch or bundle of material.

A fifth feature of the invention is a modified type of inserter where the movement is divided into two parts in order to speed up the inserter work and makes it possible—in the same module—to pick, transport and deposit both lying and raised or erected sheets.

BRIEF DESCRIPTION OF THE DRAWINGS

FIG. 2 shows a perspective view of the end sections of two adjacently arranged modules, FIG. 3 shows a perspective view of an inserter, FIG. 4 shows a perspective view of a part of the inserter according to FIG. 3, FIGS. 5*a*, 5*b* and 5*c* show different embodiments of the suction nozzles of the inserter according to FIG. 3.

DETAILED DESCRIPTION

The picking machine for sheeted material described hereinafter comprises an arbitrary number of easily assembled and interconnectable modules, each of which is entirely self-supplying. Each module is controlled by a central processing unit CPU-1 and by a microprocessor DMC-1 for each station in the module. DMC-1 in each station, shown in FIG. 7, comprises the actual core or heart of the picking machine and will be described in detail hereinafter.

Figure 1:
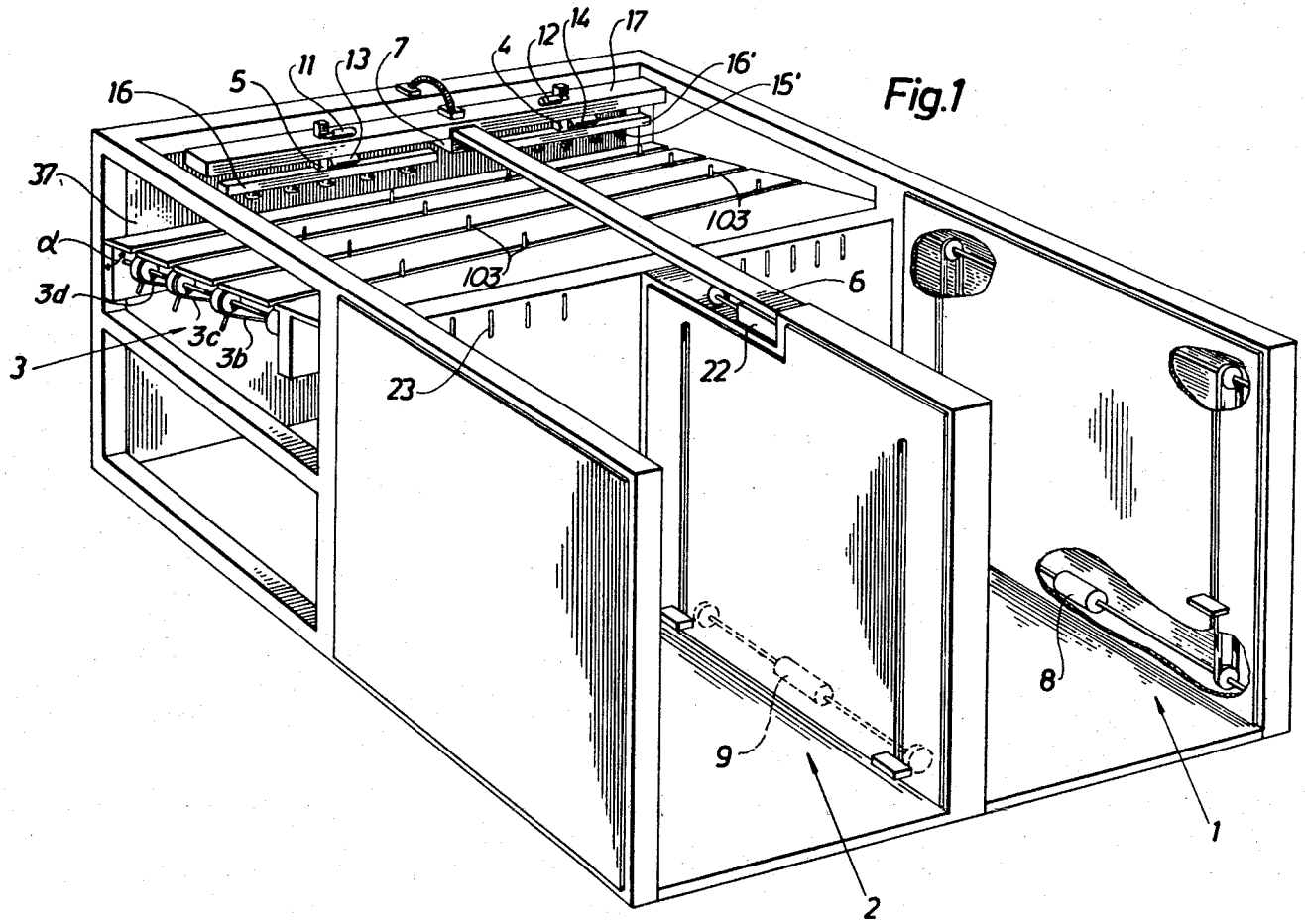
FIG. 1 shows a perspective view of a module.

Each module includes—as is evident from FIG. 1—two hoists 1 and 2, into which bundles, for instance of paper sheets, are to be placed and from which bundles one sheet at a time is to be picked and deposited on a conveyor 3 running along one side of the hoists 1 and 2. As best seen in FIG. 2, the conveyor 3 comprises a plurality of mutually parallel-running belts 3*a*–3*d*, which are provided with drivers 103 that are aligned relative to each other. The transport surface of the conveyor is inclined slightly away from the hoists 1 and 2, as indicated by the angle $\alpha$ in FIG. 1. The belts 3*a*–3*d* have furthermore been given such a direction of rotation that the direction of rotation of each belt deviates slightly from the wanted direction of transport for the sheets. The purpose of this is, in the first instance, for the sheets to be directed to the side 37 of the conveyor located farthest away from the hoists 1 and 2 in order to align one side of the sheets in relation to one another. The said side 37 of the conveyor is appropriately so devised that when several sheets are piled on top of one another the corresponding edge of the uppermost sheet is directed downwards, thereby preventing the edges from being folded upwards. The conveyor belts 3*a*–3*d* appropriately comprise toothed belts, each and every one of which forms a closed loop, which are driven synchronously and preferably stepwise by a motor 10 located in one end of the module—as particularly evident from FIG. 2. The shaft which links the motor 10 with drive wheels to the belts 3*a*–3*d* is preferably made openable at some point to allow the conveyor of an adjacent module—as particularly evident from FIG. 2—to be interconnected with the conveyor in the first-mentioned module, thereby assuring synchronous operation of the module conveyors. Synchronization of the conveyors in the various modules can naturally be attained by some other means, for example by controlling the feed to the motors 10 for the different conveyors 3 in the modules.

As particularly evident from FIG. 2, each module is provided in its front end—viewed in the direction of transport—with a plurality of recesses 27*a*–27*d*, the locations and numbers of these recesses corresponding to the locations and numbers of the idler belts 3*a*–3*d* outside the other end of the module, thereby making it possible to allow the conveyor belts of two adjacent modules to run mutually parallel a short distance into the adjacent—viewed in the direction of transport—module and also enabling two modules and their conveyors to be interconnected mechanically as stated earlier. Also other control devices for example in the form of pins 104 on one side of the module and corresponding recesses in its other side permit reliable interconnection of adjacently disposed modules.

Referring back to FIG. 1, each hoist 1 and 2 is equipped with a separate motor 8 and 9 for individual drive of each hoist. Each motor, for example 8, drives a toothed wheel (not shown) which in turn drives an endless loop, an arrangement indicated sketchwise in FIG. 1 in the hoist 1. Each hoist is naturally also equipped with devices (not shown) to stop it in correct position. In the side of the hoist 1 and 2 which is located closest to the conveyor 3 there are also a number of slots 23, designated blow holes, the purpose of which will be explained in greater detail below.

A guide rail 6 in each module runs over part of the hoists 1 and 2 and out over the conveyor 3, which guide rail 6 can in one or both ends be provided with a shock-absorbing device 22 which can be designed as a bellows which emerges in the above-mentioned blow holes 23. Instead, a separate high-speed pump can obviously achieve the required blowing—airing—of the sheets in the hoists 1 and 2. A beam 17 running perpendicular to and controlled by the guide rail 6 can be driven by for example a linear motor or by a pneumatically actuated piston rod.

As in FIG. 1, the beam 17 is equipped with a suction head 4, 5 for each hoist, i.e. it has one suction head on each side of the guide rail 6. As shown in FIG. 4, the neck 18 of each respective suction head 4 is vertically adjustable in relation to the beam 17 by means of a motor 11 having a toothed shaft 11' which engages with neck-like teeth of the neck 18. It should be noted that FIG. 4 only shows one neck and that corresponding parts must obviously also be provided at the other suction head 4. In the following description, only one suction head will be referred to and consequently it should be observed that the other suction head is similarly equipped.

As shown in FIG. 4, the suction head comprises an electrical air suction member 19, the speed and thus the capacity of which can be varied in a manner described in greater detail hereinafter. This air suction member 19 sucks air through the neck 18 of the suction head 5, which in the shown embodiment is made of a square-section pipe and which—as already mentioned—is provided at its outer end with teeth for meshing with the motor 11 to enable the neck 18 to be raised and lowered relative to the beam 17 (See FIG. 3). The neck 18 runs through the beam 17 and terminates with a solid end-piece 28, in the end of which a link 30 is slightly movable on a trunnion. This mobility or articulatability is limited by two stops 20, 21, disposed in the solid end-piece 28. The link 30 carries articulated in its turn a motor 13 and a suction head 16—as evident from FIG. 3—in such a manner that the suction head 16 can be turned approximately 180° when the motor 13 is driven. From the pipe-shaped part of the neck 18 and thus communicating with the air suction member 19 a flexible hose 29 runs down to the suction head 16, which comprises a square-section pipe with closed ends and which on its underside is equipped with nozzles 15*a*–15*e*.

Figure 5A:
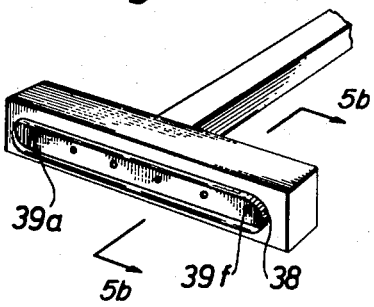
Figure 5B:
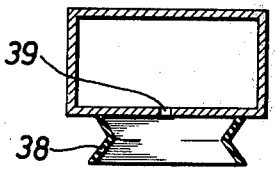
Figure 5C:
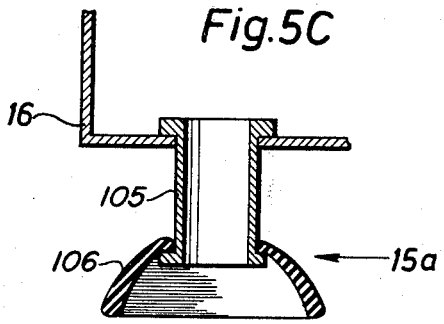

The said nozzles 15*a*–15*e*, one of which is shown in FIG. 5*c*, each comprise a pipe stump 105, fixed in a suitable manner in the square-section pipe 16, and a rubber cowl 106 placed on the end of the pipe stump. Instead, however, the underside of the suction head can be elaborated as shown in FIGS. 5*a* and 5*b* with a number of holes 39*a*–39*c*, appropriately positioned in a row, and an angular rubber moulding 38 surrounding the holes to provide a more effective action than with the embodiment according to FIG. 5*c*.

It is evident from the above that there is a direct communication between the air suction member 19 and each nozzle 15*a*–15*e* and since the speed and thus the capacity of the air suction member 19 is variable, the suction power of the nozzles 15*a*–15*e* against a sheet can also be varied, thereby enabling calibration and adjustment to be easily performed.

Figure 7:
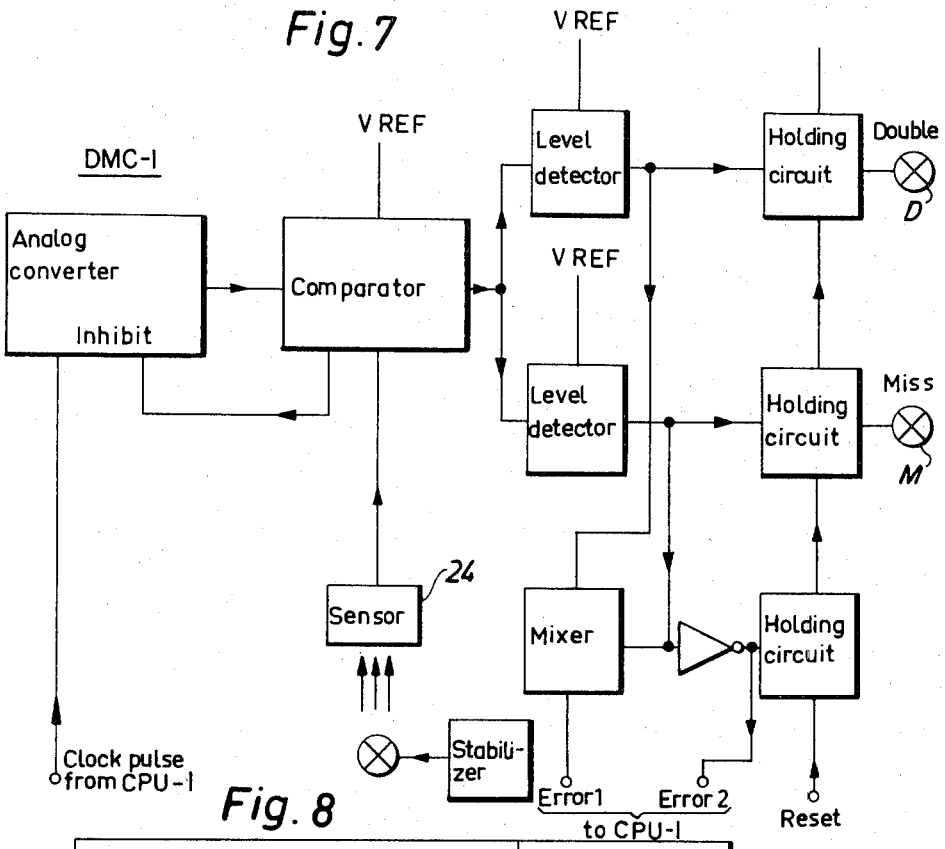
FIG. 7 shows a block diagram for the microprocessor (DMC-1) used in each station of each module.
Figure 8:
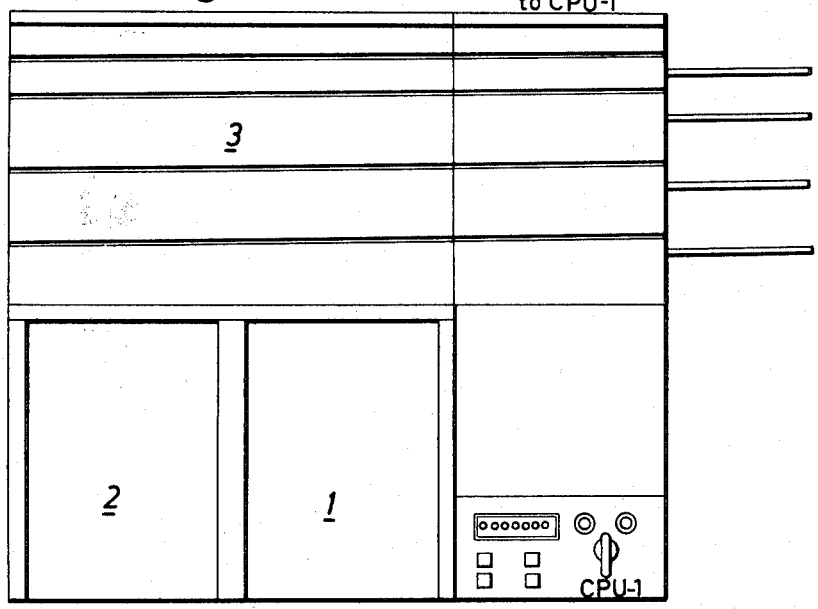
FIG. 8 shows a view from above of a module with a depositing section and appurtenant central processing unit.

The said calibration and adjustment can take place in the following manner. As shown in FIG. 3, a unit designated DMC-1 is positioned in relation to the suction head 16 and has a sensor 24, for example in the form of a specially designed photocell, which senses if one sheet, no sheet or a plurality of sheets is picked by the suction head 16. This sensing is performed for example in such a manner that the output signal generated by the photocell 24, which signal varies in level for each and every one of the aforesaid three cases, is compared in DMC-1 with a calibrated value corresponding to one sheet, and if more than one sheet is sensed a signal designated D (double) in FIG. 7 is generated and a lamp designated D in DMC-1 lights up. This indication means that more than one sheet has been picked. If, instead, a signal M (miss) is obtained and indicated on lamp M in DMC-1, this indicates a miss, i.e. no sheet at all.

The above sensing is used not only to indicate faulty picking but also to calibrate the picker so that it picks one sheet regardless of its thickness or weight. This calibration is performed by allowing DMC-1 for a certain sufficiently long time to sense a sheet in order to get a reference level corresponding to one sheet for the output signal from DMC-1, this signal being transmitted to CPU-1. The inserter is then started and commences picking, whereupon DMC-1 in the manner described above senses and transmits—if there is no sheet in the picker—a signal corresponding to a miss to a central processing unit CPU-1, which in turn instructs the air suction member 19 to increase its capacity. The suction 16 then picks yet another sheet and if DMC-1 now indicates and transmits a signal corresponding to normal the station is ready for commencement of operation. If, instead, DMC-1 indicates and still transmits a signal corresponding to a miss to CPU-1, CPU-1 orders the air suction member 19 to increase its capacity further, this being repeated until DMC-1 transmits to CPU-1 a signal corresponding to normal, i.e. one sheet. If, instead, DMC-1 indicates double, i.e. that more than one sheet has been picked, CPU-1 correspondly instructs the air suction member 19 to decrease its capacity for the next pick, this being repeated until DMC-1 transmits to CPU-1 a signal corresponding to normal, whereupon the station is ready for commencement of operation. This type of calibration is obviously usable for other types of machines than that described here, for instance for feeding of sheets into a printing press, a carton former or similar machines in which one and only one sheet is to be picked from a bundle. The same process as described above is carried out for each station in a picker which is described here.

Figure 6:
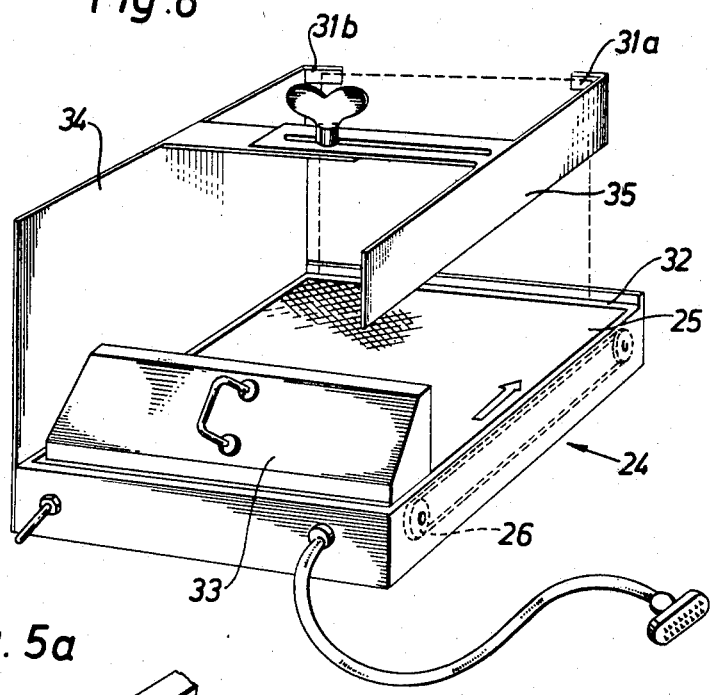
FIG. 6 shows a stacker for folded sheet material to be used, for example, in the embodiments shown in FIGS. 1 or 9.

The suction head 16 shown in FIG. 3 is also suitable for picking raised or erected sheets and also folded, raised sheets and a suitable device for stacking thereof is shown in FIG. 6. This device comprises of an endless mat 25, which is driven by a motor 26 in the direction indicated by the arrow in FIG. 6. The folded and/or raised sheets on the mat 25 which are to be picked are placed against arresters 31*a*, 31*b* and against an edge 32. The sheets also rest against a wall 34 and an adjustably setable wall section 35. A support 33 with a certain weight serves to support the sheets. The sheets are thus raised on edge between 34 and 35 and the frontmost sheet rests against the arresters 31*a*, 31*b* and against the lower edge 32, other sheets being pressed down as the mat 25 moves forward in the direction indicated by the arrow. A suction head 16, largely constructed as shown in FIG. 3 but with the motor 13 activated so that the suction head 16 is positioned at a right angle to the position shown in FIG. 3, is made to approach the frontmost sheet in the device according to FIG. 6 and when the nozzles 15*a*–15*e* approach the said sheet and appropriately its lower part, the sheet adheres by suction to the suction head 16, whereupon the suction head 16 can be removed and thus pick the sheet, turning it in the wanted manner by activation of the motor 13 and depositing the sheet in the intended place. When the sheet has been removed in this way the bundle of raised sheets in the device moves forward in consequence of the travel of the mat 25. This device is particularly suitable for use in a hoist in the above-mentioned picking machine but can obviously also be used together with a suction head separate from the picking machine described here, for instance with an enveloping machine or an addressing machine.

DMC-1 in each station in each module receives and transmits all information to CPU-1 firstly in order to cope with the above-described calibration and adjustment. It also transmits information to CPU-1 in respect of quantity counting, bundle counting and counting of missed and double sheet, respectively. CPU-1 also gives orders—if so required—for bundling, stacking, picking and folding, etc.

The actual picking, inserting and depositing stages, respectively, do not per se comprise any direct innovative features of the present invention. For this reason no closer description of them is given in the present context, it sufficing simply to state that when a picking machine according to this invention is to be arranged, a plurality of modules, the number of which corresponds to half the number of sheets to be picked, are placed side by side and interconnected mechanically in the above described manner, all DMC-1 units being then connected electrically to CPU-1, which in turn is connected electrically with and controls all drive motors in the modules.

In order to increase the picking speed of the inserter disclosed and also in order to reduce the risk of picking several material sheets at a time it has also been found appropriate in accordance with one modified embodiment of the present invention to divide the desired material movement into (a) a lifting motion and (b) a transport motion.

According to the modified embodiment of the present invention, the above has been achieved in that the inserter is equipped with at least one suction-head-equipped prelifter which is arranged to pick one material at a time from the material bundle and to move this latter material to a level at which the reciprocatingly movable suction head works.

In order to be able to handle both vertically and horizontally positioned sheets it is necessary according to a further improvement for the prelifter to be made so as to be removable. In order to assure effective transfer of sheet material from one suction head to another it is also appropriate for the suction head of the prelifter and the reciprocatingly movable suction head to be arranged by means of a resetable valve to eject a transient air surge when the material is to be released from the respective suction head.

Figures 9, 11:
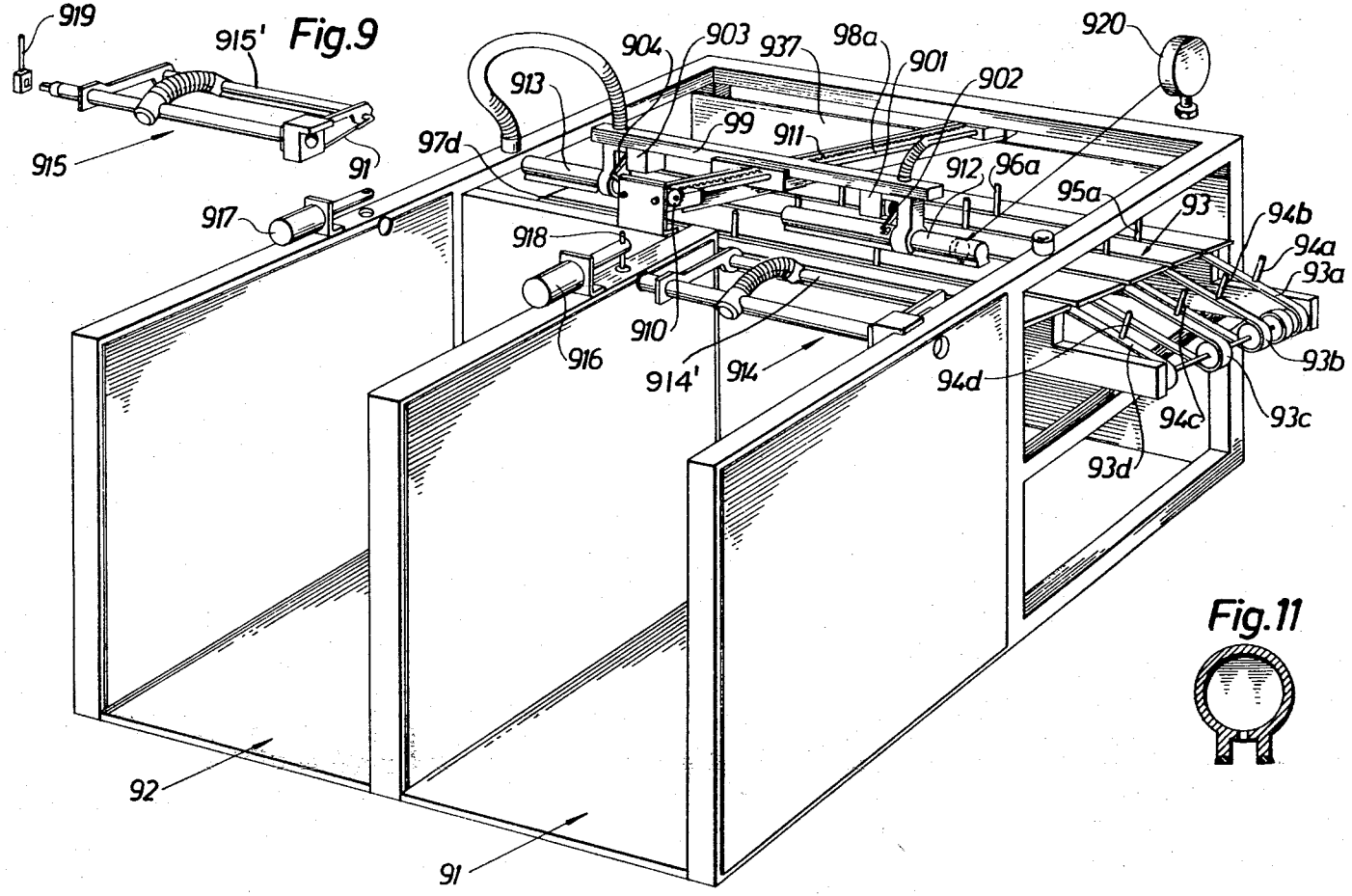
FIG. 9 shows a module with removable prelifters, which module is modified compared with that of FIG. 1.
FIG. 11 shows a sectional view through one suction head.
Figure 10:
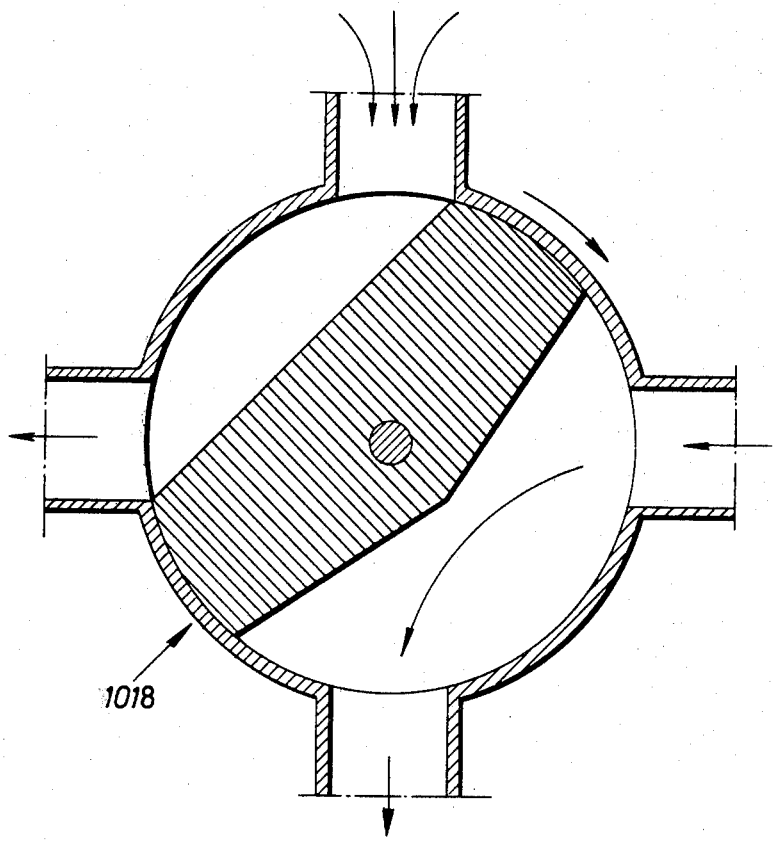
FIG. 10 shows one part of a motor-driven flap valve used in the modified module of FIG. 9

For a detailed description reference is made to FIGS. 9, 10 and 11, respectively.

The picking machine for sheeted material described hereinafter is in principle in agreement with that shown in FIGS. 1 to 8 and comprises an arbitrary number of easily assembled and connectable modules, each of which is entirely self-supplying. Each module is controlled by a central processing unit CPU-1 and by a microprocessor DMC-1 for each station in the module. DMC-1 in each station comprises the actual core of the picking machine but is described previously.

Referring to FIG. 9, each module includes two hoists 91, 92 into which bundles, for instance of paper sheets, are to be placed and from which bundles one sheet at a time is to be picked and deposited on a conveyor 93 running along one side of the hoists. The conveyor comprises a plurality of mutually parallel-running belts 93*a* to 93*d*, which are provided with drives 94*a*, 94*b* etc. that are aligned relative to each other. The transport surface of the conveyor is inclined slightly away from the hoists. The belts have furthermore been given such a direction of rotation that the direction of rotation of each belt deviates slightly from the wanted direction of transport for the sheets. The purpose of this is, in the first instance, for the sheets to be directed to the side of the conveyor located farthest away from the hoists in order thus to align one side of the sheets in relation to one another. The said side 937 of the conveyor is appropriately so devised that when several sheets are piled on top of one another the corrresponding edge of the upper-most sheet is directed downwards, thereby preventing the edges from being folded upwards. The conveyor belts appropriately comprise toothed belts, each and every one of which forms a closed loop, and which are driven synchronously and preferably stepwise by a motor (not shown) located in one end of the module. The shaft which links the motor with drive wheels to the belts is preferably made openable at some point to allow the conveyor of an adjacent module to be interconnected with the conveyor in the first-mentioned module, thereby assuring synchronous operation of the module conveyors. Synchronization of the conveyors in the various modules can naturally be attained by some other means, for example by controlling the feed to the motors for the different conveyors in the modules.

Each module is provided in its front end—viewed in the direction of transport—with a plurality of recesses as shown in FIG. 2, the locations and quantity of these recesses corresponding to the quantity of the conveyor belts outside the other end of the module, thereby making it possible to allow the conveyor belts of two adjacent modules to run mutually parallel a short distance into the adjacent—viewed in the direction of transport—module and also enabling two modules and their conveyors to be interconnected mechanically as stated earlier. Also other control devices for example in the form of pins on one side of the module and corresponding recesses in its other side (see FIG. 2) permit reliable interconnection of adjacently disposed modules. It is essential for those parts of the belts which run outside a module to be directed downwards, i.e. to dive—as shown in the right part of the module in FIG. 9—in order to attain smooth transfer of the sheets to the next module.

Each hoist is equipped with a separate motor—not shown—for individual drive of each hoist. Each motor drives a toothed wheel (not shown) which in turn drives an endless loop, as indicated in FIG. 1. Each hoist is naturally also equipped with devices (not shown) to stop it in the correct position. In the side of the hoists which is located closest to the conveyor there are also a number of slots, designated blow holes—as shown in FIG. 1—the purpose of which will be explained in greater detail below.

Two guide rails such as rails 98*a* in each module run over part of the hoists 91, 92 and out over the conveyor, which guide rails can in one or both ends be provided with a shock-absorbing device which can be designed as a bellows which emerges in the above-mentioned blow holes. Instead, a separate high-speed pump can obviously achieve the required blowing—airing—of the sheets in the hoists. A beam 99 running perpendicular to and controlled by the guide rails can be driven by for example a toothed belt 911 driven by a motor 910. The beam 99 is equipped with a suction head 912 and 913, respectively, for each hoist, i.e. it has one suction head on each side of the guide rails 98*a*, 98*b*.

Each hoist 91 and 92, respectively, in each module is provided with a prelifter 914 and 915, respectively, each prelifter being arranged to be removable—as shown to the left in FIG. 9—or possibly so that it can be moved aside—not shown—in order to enable raised sheets, for example folded sheets, to be picked from the sheet bundles carried in the hoists. These prelifters are appropriately designed with the same type of adjustable suction heads 914', 915' as the suction heads 912, 913 achieving the reciprocating motion.

A particularly simple and appropriate embodiment, shown in FIG. 9, is if the prelifters are turned by means of a motor 916 or 917 and a lever 918 or 917 from a lower position, in which a sheet material is picked, to an upper position, in which the transport suction head 912 or 913 takes over the largely horizontal transport of the sheet material to the conveyor 93 while retaining a largely horizontal position on the part of the suction head. This is achieved with the aid of a lever 91.

Each suction head 914',915' of the prelifters 914,915 is turnable relative to its associated prelifter so as to largely retain its same position irrespective of the turning of its associated prelifter.

When the material sheet is being transferred from the prelifter 914 or 915 to the transport suction head 912 or 913 it is appropriate for the prelifter to emit en ejecting air surge at the same time as the transport suction head takes hold of the sheet by suction. Additionally, it is appropriate if also the transport suction head 912 or 913 upon completion of its forward movement emits an ejecting air surge so as to deposit the sheet material on the conveyor. These transient air surge may be attained with the aid of a motor-driven flap valve 1018 shown in FIG. 10.

Each suction head 912 or 913 is suspension-mounted and is turnable around its central shaft with the aid of a motor 901 or 903 with appurtenant levers 902 or 904, whereupon the turning of the suction head is always performed at the same level, i.e no movement of the suction head relative to the picked paper sheets occurs, thereby avoiding the risk of smudging newly printed text.

The suction heads 912,913 are—as evident from FIGS. 9 and 11—designed in this case as suction heads with an adjustable stop 920, thereby facilitating setting of the size of the sheets to be picked and transported.

I claim:

1. In an inserter for picking, transportation and depositing of non-rigid sheet-like or folded material one at a time from a material bundle to a depositing station, the improvement comprising:

at least one reciprocatingly movable suction head (912,913) mounted relative to said material bundle so as to be operable at a given level, and being reciprocatingly movable in only one plane from a first position in said one plane above said material bundle but proximal to that end part of said material bundle located nearest to a depositing station to a second position in said one plane at said depositing station and back again to said first position for transport of said material;

means for imparting said reciprocating movement to said at least one reciprocatingly movable suction head (912,913) in said only one plane;

at least one prelifter (914,915) having a suction head and being mounted adjacent said material bundle to pick up at least the end portion of one material at a time from said material bundle to move at least said end portion of the picked-up material to said given level at which said at least one reciprocatingly movable suction head (912) operates; and said suction head of said at least one prelifter meeting said at least one reciprocatingly movable suction head at said given level and at said first position at the same time.

* * * * *